United States Patent [19]

Goldammer

[11] 4,067,625

[45] Jan. 10, 1978

[54] RESOLVING ROLLER

[75] Inventor: Georg Goldammer, Gaimersheim, Germany

[73] Assignee: Schubert & Salzer Maschinenfabrik Aktiengesellschaft, Ingolstadt, Germany

[21] Appl. No.: 696,832

[22] Filed: June 17, 1976

[30] Foreign Application Priority Data

June 26, 1975 Germany ..... 2528485

[51] Int. Cl.[2] ..... F16C 35/08

[52] U.S. Cl. ..... 308/149; 308/20

[58] Field of Search ..... 308/20, 149, 151, 152

[56] References Cited

U.S. PATENT DOCUMENTS

| | | | |
|---|---|---|---|
| 2,717,071 | 9/1955 | Cook | 308/20 |
| 2,850,822 | 9/1958 | Masters | 308/20 |
| 3,927,921 | 12/1975 | Woolley | 308/9 |

*Primary Examiner*—Richard A. Bertsch

*Attorney, Agent, or Firm*—Robert W. Beach; R. M. Van Winkle; Ward Brown

[57] ABSTRACT

The peripheral fittings for resolving sliver are carried by an annular sleeve. Such sleeve is removably mounted concentrically of the resolving roller shaft by a centering roller body carried by the shaft. A resilient member is radially spread by a clamping ring to frictionally interconnect the roller body and the fittings sleeve for maintaining the sleeve in desired axial relationship and for transmitting force from the shaft and roller body to the peripheral fittings to effect conjoint rotation.

17 Claims, 3 Drawing Figures

Fig.1
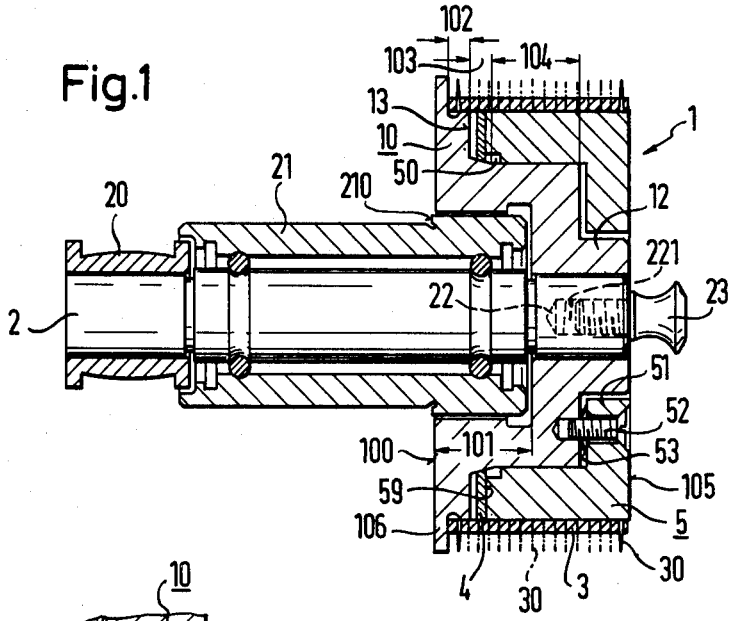
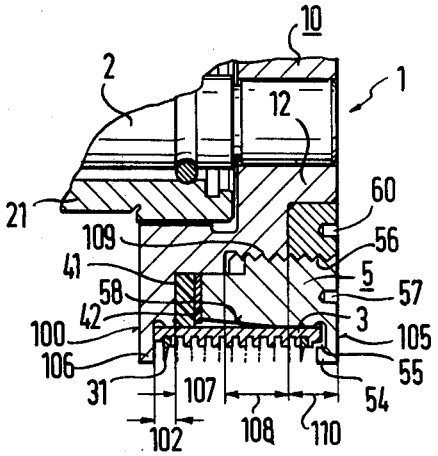
Fig. 2
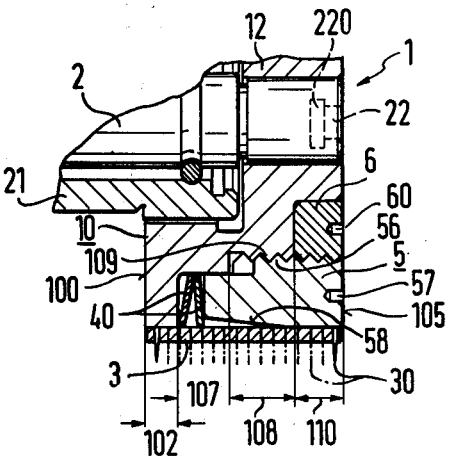
Fig.3

RESOLVING ROLLER

BACKGROUND OF THE INVENTION

1. Field of the Invention

The present invention relates to a composite resolving roller having exchangeable fittings carried by a roller body and secured by a clamping ring threadedly connected to the roller body.

2. Prior Art

Because the sets of resolving rollers for open end spinning machines are heavily used during resolving of fiber sliver, the fittings are subjected to an extremely high rate of wear. Therefore, the resolving rollers must be replaced periodically.

In order to avoid replacement of the entire resolving roller, fittings have been provided on sleeves which can slide onto a roller body, and a clamping disk is screwed onto the body to hold the sleeve in place. (Japanese Utility Model Publication No. 2913/73).

Such prior construction has not eliminated the problem of special machining upon exchange of fittings. Because it is necessary to have very close tolerances between the resolving roller ends and the corresponding walls of the roller housing for such technological reasons as maintaining fiber-directing air currents and avoiding spaces in which fiber can lodge, it has been necessary to grind the roller ends. Such grinding has been necessary both upon initial installation and upon each exchange of fittings. Since repeated grinding reduces the roller size, the roller body, or at least the clamping disk, must be replaced frequently. It is also necessary to utilize skilled technicians and special tools for each fittings change.

SUMMARY OF THE INVENTION

It is the principal object of the present invention to provide a resolving roller construction which makes it economically and flexibly feasible to make frequent changes of the resolving fittings.

A companion object is to provide such roller construction that roller length can be set by unskilled personnel and without special tools.

Another important object is to facilitate greater flexibility in changing fittings to accommodate variations in sliver characteristics.

The foregoing objects can be accomplished in accordance with the present invention by interposing a resilient spreadable member between the fittings sleeve and the roller body. The clamping ring exerts axial force on the resilient member and spreads it radially to effect frictional interconnection both axially and rotationally between the roller body and the fittings sleeve throughout a range of axial adjustments of the clamping ring. Consequently, the fittings sleeve is axially secured relative to the roller body, and the sleeve and roller body will rotate without slip. Because of the resilience of the spreading member, the clamping ring which forms one end of the composite roller can be set to fix the necessary roller length without reducing the rotational power connection between the fittings sleeve and the roller body.

The resilient member can be made of various materials, but it is preferred that such member be of rubber or soft plastic to maximize the range of clamping ring axial settings. The resilient member can be made of one or more sections and can be bonded or otherwise affixed to the roller body, or to the clamping ring, or sections can be affixed to each of the body and the ring.

It is of particular advantage for the resilient member to be independent of either the roller body or the clamping ring so that it is loosely received between concentric surfaces of the roller body and the fittings sleeve. With such construction, the resilient member can be replaced easily when it is worn; rubber elements, for example, tend to lose resilience with age. Such an independent resilient member can take various forms but conveniently may be ring shaped. The roller body may have an axial section of reduced diameter for receiving the resilient ring. To ensure accurate centering of the clamping ring and spreading engagement with the resilient member, it is preferred that the resilient member be of smaller axial extent than the corresponding roller body reduced axial section. The inner surface of the clamping ring would be complemental to such reduced roller body portion and would be guided thereby for centering of the clamping ring and for applying axial pressure on the resilient member.

When the clamping ring is adjusted relative to the roller body for forming a roller of proper axial extent, the two components can be connected by one or more screws. However, it is preferred that the roller body be formed with a stepped hub. The larger diameter hub section would be externally threaded complemental to internal threads of the clamping ring. The smaller diameter hub section would provide an annular space between it and the clamping ring, which space may receive a locknut. This arrangement prevents relative tilting of the clamping ring and the roller body so that the remote ends of these components are maintained in parallel relationship constituting the composite roller ends, and the clamping ring will not bind on any portion of the fittings sleeve. Such precise centering is more difficult to maintain if a plurality of screws are used as the connecting means.

The clamping ring outer circumference preferably has a first cylindrical portion extending from its axial end forming a composite roller end to a second frustoconical portion tapered toward its resilient member engaging end. Consequently, the leading end is relieved to reduce drag and facilitate centering during assembly. The roller body portion forming the other roller end may have a radial flange to form a stop for the fittings sleeve. Similarly, a radial flange on the clamping element may embrace the other sleeve edge. In order to avoid bending the sleeve edges during assembly, such a clamping ring flange may have an annular groove for receiving the sleeve edge margin. Such groove would have a depth selected so that no axial pressure would be exerted on the fittings sleeve even when the shortest roller length is set.

An end of the resolving roller shaft projects beyond its bearing a distance sufficient to receive the resolving roller, and the shaft end is flush with the outer end of the composite roller. It is preferred that the shaft end be provided with a bore to receive a tool or a handle by which the shaft can be pulled or pushed in the axial direction for removing or replacing the shaft and the resolving roller as a unit.

With the construction of the present invention, the fittings sleeve is not mounted by axial engagement with any portion of the composite roller so that the axial length of the roller is settable to any desired axial dimension. Since the fittings sleeve is held in place by radial forces, the radial flanges on the roller body and- /or on the clamping ring may be omitted as desired. The fittings sleeve is an independent unit. Consequently, if it is desired to change the fittings, only that portion of the composite roller which technologically affects the sliver, namely the fittings sleeve, need be exchanged. Even after numerous fittings changes, no replacement or substitution for the roller body or the clamping ring is necessary. For these reasons, it is practical to change fittings when the material forming the sliver is changed without reducing the life of the roller.

BRIEF DESCRIPTION OF THE DRAWINGS

FIG. 1 is an axial section through a resolving roller of the present invention.

FIG. 2 is a fragmentary axial section through a modified resolving roller according to the present invention.

FIG. 3 is a fragmentary axial section similar to FIG. 2 but showing the resolving roller without sleeve-embracing flanges.

DETAILED DESCRIPTION

The resolving roller 1 is formed compositely of four principal components, namely a roller body 10, a sleeve 3 carrying fittings 30, a resilient member 4 interposed between substantially concentric surfaces of the roller body and the fittings sleeve, and a clamping ring 5 which exerts axial force to spread the resilient member radially, as described further below. A housing (not shown) conventionally closely embraces opposite ends 100 and 105 of the composite roller 1. One end of shaft 2 carries the roller body 10, which is keyed or pressed on such shaft for rotation therewith. The opposite shaft end carries a shaft driving element, such as a sheave 20. A shaft bearing 21 is interposed between the roller body shaft engaging portion and the sheave. The bearing projects through the roller housing wall and has a shoulder 210 which engages the inner side of such a housing wall to limit movement of the bearing to the left, as seen in FIG. 1. In order to position the roller end 100 closely adjacent to shoulder 210 and, therefore, to the housing wall, roller body 10 has an interior cylindrical bore 101 for receiving the end portion of bearing 21.

The outer cylindrical surface of roller body 10 is stepped in the axial direction from a large diameter end portion adjacent to its end 100 forming the inner roller end face downward to the smallest diameter section having an end face substantially coplanar with the outer end face 105 of the composite roller 1. The largest diameter section 102 forms a first roller body section which is complemental to but slightly smaller than the internal diameter of fittings sleeve 3 so that one sleeve margin can be easily slid over section 102. Stepped down from section 102 is a second, preferably frustoconically tapered, section 103. The two sections are connected by a radial riser 13. Section 103 forms the inner bearing surface for resilient member 4. Section 103 adjoins a third section 104 which forms a centering surface for clamping ring 5.

The resilient member is shown in FIG. 1 as an annular ring 4, the inside diameter of which corresponds to the smallest diameter of the tapered bearing section 103. The outside diameter of ring 4 is nearly equal to the inside diameter of fittings sleeve 3. The radially inner and outer edges of ring 4 bear respectively on tapered section 103 and an interior surface portion of sleeve 3. Roller body section 103, riser 13 and sleeve 3 form an annular compartment for ring 4, which compartment has decreasing radial extent in the direction toward riser 13. The fourth wall of the compartment is formed by the inner end 59 of clamping ring 5, which end is substantially parallel to riser 13. As clamping ring 5 is axially inserted between roller body 10 and sleeve 3, the end 59 axially presses ring 4 toward riser 13 and wedges the ring into the narrower portion of the compartment.

Ring 5 preferably has an axial extent greater than one-half of the axial extent of sleeve 3 and has an outside diameter substantially equal to the diameter of roller body section 102, namely, slightly smaller than the inside diameter of sleeve 3. The inside diameter of clamping ring 5 is substantially equal to the diameter of roller body section 104 so that in assembling the composite roller 1, section 104 guides and centers clamping ring 5. The interior margin of the clamping ring adjacent to its end 59 is relieved such as by a bevel or a notch 50 so that such end 59 can be moved inwardly past the junction between roller body portions 104 and 103.

The axial end portion of clamping ring 5 opposite resilient member engaging end 59 preferably has a radially inwardly projecting flange 51, and the roller body has a hub 12 stepped down from centering section 104. The outer face 105 of flange 51 and ring 5 defines the outer end of composite roller 1. The end face of hub 12 is substantially coplanar with or recessed from face 105 in any adjusted position of clamping ring 5 so that roller body face 100 and clamping ring face 105 define the axial extent or length of roller 1.

In the form of the invention shown in FIG. 1, the assembled roller 1 is secured and its length set by countersunk screws 52 extending through clamping ring flange 51 and into registering bores in the radial riser connecting centering portion 104 and hub 12 of the roller body 10. The screws may be held in position by locking disks 53 such as lock washers or Belleville springs. The roller length is set by tightening screws 52 to move clamping ring 5 toward the resilient ring until the desired length of roller 1 is attained. Because of the taper of section 103 and the resilience of ring 4, such resilient ring will provide sufficient frictional interconnection between roller body 10 and fittings sleeve 3 throughout a range of adjusted positions of clamping ring face 105 relative to roller body face 100 so that sleeve 3 cannot shift axially and will be rotated conjointly with roller body 10 by shaft 2.

While the frictional interconnection of roller body 10 and fittings sleeve 3 effected by resilient member 4 is sufficient to prevent axial movement of the fittings sleeve relative to roller body 10 when clamping ring 5 is secured in place, if desired a radial flange 106 may be provided between roller body face 100 and sleeve guiding portion 102 as a stop to limit inward movement of sleeve 3 during assembly.

In this description, the roller end defined by roller body face 100 is referred to as the inner roller end because this end is closest to drive element 20 and assembly of the composite roller following a fittings change would commonly be effected by moving the components axially from the free end of shaft 2 toward sheave 20. Sheave 20, bearing 21 and roller body 10 may remain mounted in the operating position relative to the housing (not shown) during a fittings change. During assembly of composite roller 1, fittings sleeve 3 would be moved axially of roller body 10 until the inner sleeve margin encircles guide portion 102 and, if provided, engages stop 106. Next, resilient ring 4 would be inserted into its compartment 3, 13, 103. Then, clamping ring 5, carrying screws 52 and locking washers 53, would be inserted and moved inwardly while being centered and guided by roller body portion 104 until end 59 engages resilient member 4. Screws 52 would then be tightened until the desired spacing between roller ends 100 and 105 is set. Such setting can be made by use of a micrometer caliper or other suitable gauge so that precision assembly can be effected by a person who is relatively unskilled.

In addition to flange 106, serving as a stop for the inner edge of fittings sleeve 3, a similar flange may be provided on the clamping ring 5 adjacent to its outer face 105. Such a flange 54 is shown in FIG. 2. In order to avoid interference with the range of adjustment for clamping ring 5 to prevent axial force from being exerted on sleeve 3 and to avoid bending of flanges 106 and 54 or relative tilting of the axis of roller body 10 and clamping ring 5, an annular groove 55 is provided on the side of flange 54 adjacent to sleeve 3. Groove 55 has a depth sufficient that the edges of sleeve 3 cannot engage both flange 106 and flange 54 even when clamping ring 5 is moved farthest toward resilient member 4 corresponding to the shortest axial distance between roller ends 100 and 105. Such a flange 54 may facilitate control of the position of sleeve 3 during assembly by preventing it from sliding outwardly but it mainly serves to shield the fingers of a worker from engagement with the usually sharp fittings on sleeve 3 during assembly and disassembly of clamping ring 5. However, as shown in FIG. 3, both flanges 106 and 54 can be eliminated because they have no function after the roller is assembled. As stated above, the resilient member provides adequate control over both axial and circumferential positions of fittings sleeve 3 when clamping ring 5 is secured in place.

Because the fittings on sleeve 3 operating on sliver and the fiber resolved therefrom directly affect properties of the yarn spun from the fiber, it is important to have the capability of quickly and easily exchanging fittings upon change of the fiber material to be spun, or when a change in yarn properties to be spun from a particular type of fiber is desired. The two principal types of fittings are represented in the drawings, namely, needle fittings 30 in FIGS. 1 and 3 and tooth fittings 31 in FIG. 2. However, there are many variations and effects which can be achieved by selecting different combinations of characteristics, for example, shape and length of needles 30, needle angle, needle thickness, needle material, or, in the case of teeth 31, tooth shape, tooth inclination or angle, number of tooth tips per unit of surface area, spacing between the teeth, material and polish.

It is important that changes of fittings can be accomplished quickly not only to reduce down time when they must be replaced because of wear, but also to make it practical to adapt the fittings to changes in fiber material or yarn characteristics. Such fittings changes can be effected more quickly if the clamping ring 5 is screwed directly onto a hub of roller body 10 instead of being fastened by a plurality of screws 52. Such construction is shown on FIGS. 2 and 3 and is described more specifically with reference to FIG. 3. As before, roller body 10 has a sleeve guiding portion 102 adjacent to inner roller end face 100. The resilient member bearing surface is adjacent to and stepped down from portion 102, but such bearing surface 107 is cylindrical instead of frustoconical, and the resilient member is shown as annular plates or Belleville springs 40. There may be a single such spring or a plurality of springs 40 forming the resilient friction-connecting means between roller body and fittings sleeve 3. The outside diamter of each spring 40 is only slightly smaller than the inside diamter of sleeve 3 so that radial expansion of the springs when engaged by clamping ring 5 will be sufficient to effect the friction interconnection of members 3 and 10. The axial extent of springs 40 is substantially less than the axial extent of cylindrical surface 107 and the excess axial portion of such surface forms the centering portion complementally engageable with the inner surface of clamping ring 5.

The hub 12 of roller body 10 preferably is stepped to include a diametrally larger portion 108 and a diametrally smaller portion 110 adjacent to and encircling the free end of shaft 2. The larger hub portion 108 carries circumferential threads 109 complemental to internal threads 56 of clamping ring 5. In order to effect frictional interconnection of roller body 10 and fittings sleeve 3, resilient members 40 are expanded to engage positively sleeve 3 and roller body surface 107 by insertion of clamping ring 5 between the sleeve and the roller body. Such clamping ring, by its threads 56, is screwed onto threads 109 of hub portion 108. When the desired roller width is attained, locknut 6 having external threads complemental with clamping ring threads 56 is inserted between the clamping ring and the reduced portion 110 of hub 12. To facilitate threading rotation of clamping ring 5 and tightening of locknut 6, sockets 57 and 60 are provided in their respective outer faces to receive corresponding projections of a wrench.

If a threaded connection is desired for a roller 1 utilizing a wedging surface 103 and a resilient member 4, as shown in FIG. 1, the threaded hub portion 108 would not be directly adjacent to wedging surface 103. Instead, centering surface 104, preferably of somewhat shorter axial extent, would be provided between surface 103 and hub portion 108 to engage an unthreaded internal surface of a clamping ring 5 to assure that the axes of the clamping ring and the roller body 10 are maintained coincident when the clamping ring is threaded onto the hub. While clamping ring 5 is shown to have a cylindrical outer surface in FIG. 1, it may be provided with a frustoconically tapered inner end portion 58 adjacent to the resilient member to minimize any danger of binding in sleeve 3 while the clamping ring is being centered and locked into the selected position.

The resilient member can take various forms. In FIG. 1, it is shown as the resilient ring 4 which is wedged into its cavity 103, 13, 3. A plurality of dished or Belleville springs 40 are shown in FIG. 3 which are diametrally expanded by the axial pressure exerted by clamping ring 5. The inner end of clamping ring 5 could be extended and provided with a plurality of axial slits so that the circumference of such end portion would be flexibly expanded by the wedging surface 103. It would also be possible to eliminate the tapered portion 103 of the roller body and the cutaway 50 of clamping ring 5 and provide separate tapered rings on opposite sides of resilient ring 4, which tapered rings would be wedged toward each other as clamping ring 5 is inserted and moved into the cavity containing the wedging rings and resilient member 4.

The resilient element 4 could be made of elastomeric material, such as rubber or soft plastic, having an axial extent greater than the spacing between roller body face 13 and the inner end of clamping ring 5 when the clamping ring is set to form a roller 1 of maximum axial extent between roller end faces 100 and 105. As the resilient element is compressed axially by insertion of clamping ring 5, it will expand radially to effect the frictional interconnection between roller body 10 and fittings sleeve 3. Such a resilient member is shown in FIG. 2 as the element 41. Such a rubber or plastic element is especially economically and a wider range of roller length settings of clamping ring 5 can be effected. Such a range can be further extended by providing a spacer or extender 42 also of resilient material. This type of resilient member also permits larger manufacturing tolerances for the roller components 5, 10.

The resilient member 4, 40, or 41, 42 can be connected to the clamping ring 5 or the roller body 10 by adhesive bonding or vulcanizing. However, it is preferred that the resilient member be independent of either roller component so that it can be easily replaced as would be desirable, for example, when a rubber or soft plastic element ages and loses its resiliency.

In the foregoing description the resilient member has been described as a ring which encircles a portion of the roller body and is diametrally or radially expanded by a clamping ring which is inserted axially over the hub 12 to encircle a portion of the roller body. But this construction is not an indispensible prerequisite for achieving the object of the present invention. For example, the roller body 10 and the clamping element 5 may be substantially cylindrical and have substantially equal radii. The faces of each component which are adjacent to the resilient member would be substantially parallel. A disk shaped resilient member would be received between such parallel faces and would be compressed axially between them to effect radial expansion to engage the inner surface of fittings sleeve 3. Clamping element 5 would also be disk shaped. In this instance, the resilient member would have axially extending apertures through which the screws 52 could pass for interconnecting the roller body 10 and the clamping member 5. In some applications, a single screw 52 located at the axis of disk 5 would be sufficient to connect clamping member 5 to roller body 10 or the end of shaft 2. With a disk shaped member 5, the axial length of roller 1 can be selected over a wide range by providing disks of different thicknesses.

As indicated earlier, flange 54 on clamping ring 5 (FIG. 2) can be omitted. In such a case, it would be necessary for maintenance workers to wear heavy gloves in order to avoid injuries from fittings 30 or 31 when mounting or demounting the complete unit including roller 1, shaft 2, bearing 21 and finally the drive element shown by way of example as a sheave 20. Other means of pulling the unit may be provided as shown in FIGS. 1 and 3. A bore 22 may be provided in the end of shaft 2 which extends through roller body 10 and is exposed at the face of hub 12. In FIG. 3, a concentric or eccentric recess 220 is provided at the blind end of bore 22 for receiving the hook of a pulling tool. In FIG. 1, bore 22 has internal threads 221 to receive a correspondingly threaded stem of a handle 23. If desired, a plurality of bores 22 could be provided in the outer roller end 105 or the face of hub 12. The unit can then be mounted or demounted by exerting an axial pushing or pulling force on a tool or a handle 23 inserted in a bore of bores 22.

In the foregoing description, a multiplicity of variations and constructions for achieving the results of the present invention have been disclosed whereby individual features can be combined in different ways or can be replaced by equivalent components. The common characteristics of all such combinations is that an exchangeable fittings sleeve 3 is frictionally interconnected with roller body 10 by a resilient member 4, 40 or 41, which member is radially expanded by axial force exerted by a clamping element 5 threadedly connected to the roller body. The resilient member effects such interconnection through a range of relative adjusted positions of the roller body and the clamping element. The radial connection between the roller body 10 and the fittings sleeve 3 effects both rotational and relative axial interconnection so that limiting means such as flanges 106 and 54 are unnecessary for maintaining the axial placement of the fittings sleeve. Consequently, the entire axial extent of the fittings sleeve is usable to resolve sliver and a source of crevices for entrapping fibers is eliminated.

I claim:

1. A resolving roller comprising:

a fittings sleeve;

a roller body for carrying said fittings sleeve which roller body has a generally radial riser portion;

drive means for rotating said roller body;

a clamping member connectible with said roller body for conjoint rotation therewith, said clamping member including a generally radial portion spaced from said roller body riser portion for forming therewith a resilient means-receiving cavity and an outer circumferential surface for receiving said fittings sleeve;

means for connecting said roller body and said clamping member and for effecting adjustment of the axial width of said resilient means-receiving cavity; and resilient means in said resilient means-receiving cavity for effecting radial expansion by adjustment of the axial width of said cavity and for holding said fittings sleeve on said roller body for conjoint rotation therewith.

2. The resolving roller defined in claim 1, in which the resilient means frictionally interconnects the fittings sleeve and the roller body.

3. The resolving roller defined in claim 2, in which the resilient means is made of elastomeric material.

4. The resolving roller defined in claim 2, in which the resilient means includes a Belleville spring.

5. The resolving roller defined in claim 2, in which the cavity has an inner axial side formed by a circumferential portion of the roller body.

6. The resolving roller defined in claim 5, in which the inner axial side of the cavity is substantially frustoconically tapered toward the clamping member.

7. The resolving roller defined in claim 6, in which the interior margin of the clamping member adjacent to the inner axial side of the cavity is cutaway.

8. The resolving roller defined in claim 5, in which the roller body is stepped and includes a first circumferential portion having a radius slightly less than the interior radius of the fittings sleeve and a second circumferential portion having a radius less than the radius of said first circumferential portion, said second circumferential portion forming the cavity inner axial side.

9. The resolving roller defined in claim 8, in which the axial extent of the resilient means is less than the axial extent of the roller body second circumferential portion, and the clamping member portion adjacent to the roller body riser portion is ring shaped, said ring shaped clamping member portion being substantially circumferentially engaged with the roller body second circumferential portion and being centered thereby relative to the roller axis.

10. The resolving roller defined in claim 9, the roller body having a stepped hub including a threaded portion and a reduced portion at the side of said threaded portion remote from the resilient means, the clamping member having a first internally threaded portion threadedly connectible with said hub threaded portion and a second threaded portion substantially concentric with and radially spaced from said hub reduced portion, and a locknut receivable between the clamping member and said hub reduced portion and threadedly connectible with said clamping ring second threaded portion.

11. The resolving roller defined in claim 2, in which the resilient means is ring shaped and is loosely received in the cavity and unattached to any cavity side.

12. The resolving roller defined in claim 2, in which the clamping member end portion remote from the resilient means has a substantially cylindrical surface and the opposite end portion is substantially frustoconically tapered toward the resilient means, the clamping member being slidably insertible axially into the fittings sleeve with its tapered end portion leading.

13. The resolving roller defined in claim 2, in which the roller body end remote from the clamping member carries a radial flange stop engageable by an edge of the fittings sleeve.

14. The resolving roller defined in claim 2, in which the clamping member end remote from the resilient means carries a radial flange shielding an edge of the fittings sleeve.

15. The resolving roller defined in claim 14, in which the clamping member radial flange includes an annular groove in its side adjacent to the fittings sleeve, said groove having inner and outer radii of an extent such that the adjacent fittings sleeve end margin is receivable in said groove.

16. The resolving roller defined in claim 2, and a shaft connecting the roller and the drive means, said shaft extending through the roller and having an end substantially flush with the roller end, said shaft end having a bore, and gripping means receivable in said shaft end bore for pulling the roller and shaft apart from the drive means.

17. The resolving roller defined in claim 16, in which the shaft end bore is threaded, and the gripping means is a handle threadedly insertible in the shaft end bore.

* * * * *